US011835013B2

(12) United States Patent
Hirschmann et al.

(10) Patent No.: US 11,835,013 B2
(45) Date of Patent: Dec. 5, 2023

(54) CYLINDER HEAD FOR AN INTERNAL COMBUSTION ENGINE AND METHOD FOR THE PRODUCTION THEREOF

(71) Applicant: MAN Truck & Bus SE, Munich (DE)

(72) Inventors: Steffen Hirschmann, Neustadt an der Aisch (DE); Thomas Malischewski, Heilsbronn (DE)

(73) Assignee: MAN TRUCK & BUS SE, Munich (DE)

( * ) Notice: Subject to any disclaimer, the term of this patent is extended or adjusted under 35 U.S.C. 154(b) by 0 days.

(21) Appl. No.: 17/274,144

(22) PCT Filed: Aug. 30, 2019

(86) PCT No.: PCT/EP2019/073192

§ 371 (c)(1),
(2) Date: Mar. 5, 2021

(87) PCT Pub. No.: WO2020/048883

PCT Pub. Date: Mar. 12, 2020

(65) Prior Publication Data

US 2021/0348580 A1 Nov. 11, 2021

(30) Foreign Application Priority Data

Sep. 6, 2018 (DE) ..... 10 2018 121 723.4

(51) Int. Cl.
*F02F 1/28* (2006.01)
*F02F 1/36* (2006.01)
(Continued)

(52) U.S. Cl.
CPC ..... *F02F 1/36* (2013.01); *F02F 1/4235* (2013.01); *F02F 1/4264* (2013.01); *F02F 2001/244* (2013.01)

(58) Field of Classification Search
CPC ..... F01P 1/00; F01P 2001/026; F01P 1/08; F01P 3/00; F01P 2003/001; F01P 2003/024
See application file for complete search history.

(56) References Cited

U.S. PATENT DOCUMENTS 3,102,381 A * 9/1963 Tryhorn ..... F02B 37/168 60/600
4,046,114 A * 9/1977 Hamparian ..... F02F 1/4214 60/272

(Continued)

FOREIGN PATENT DOCUMENTS

CN 106014579 A 10/2016
CN 106812622 A 6/2017

(Continued)

OTHER PUBLICATIONS

JP 2013221459 translation (Year: 2013).*

(Continued)

*Primary Examiner* — George C Jin
*Assistant Examiner* — Teuta B Holbrook
(74) *Attorney, Agent, or Firm* — WEBER ROSSELLI & CANNON LLP

(57) ABSTRACT

The disclosure relates to a cylinder head for covering a combustion chamber of an internal combustion engine. The cylinder head comprises at least one material recess for heat isolation, which is formed in a main body of the cylinder head and is arranged between a fluid-guide channel and a cooling channel. The material recess can be produced e.g. directly during the shaping (e.g. casting or pressing) of the cylinder head and/or thereafter. For example, in the event that exhaust gas is guided through the fluid-guide channel, a significantly lower heat input occurs from the hot exhaust gas into the cooling fluid. In addition, the thermal decou- (Continued)

pling via the material recess leads to the hot exhaust gas cooling to a lesser degree in the fluid-guide channel.

20 Claims, 5 Drawing Sheets

(51) Int. Cl.
*F02F 1/42* (2006.01)
*F02F 1/24* (2006.01)

(56) References Cited

U.S. PATENT DOCUMENTS

| | | | | | |
|---|---|---|---|---|---|
| 4,079,704 | A * | 3/1978 | Hayashi | F01P 1/08 | 123/188.14 |
| 4,445,486 | A * | 5/1984 | Rao | F01P 9/04 | 123/41.42 |
| 4,825,816 | A * | 5/1989 | Yamada | F01P 1/02 | 123/41.42 |
| 4,873,944 | A * | 10/1989 | Yamada | F01P 3/02 | 123/41.57 |
| 4,972,674 | A | 11/1990 | Yamada et al. | | |
| 2002/0029752 | A1* | 3/2002 | Laimbock | F02F 1/22 | 123/41.57 |
| 2006/0144040 | A1* | 7/2006 | Westerbeke, Jr. | F01N 3/2046 | 60/323 |
| 2010/0186396 | A1* | 7/2010 | Rippert | F02F 1/4264 | 123/193.5 |
| 2010/0294226 | A1* | 11/2010 | Gupta | F02M 35/10078 | 123/184.21 |
| 2012/0148853 | A1* | 6/2012 | Wakamatsu | F01N 13/102 | 428/457 |
| 2015/0167583 | A1 | 6/2015 | Sakamoto et al. | | |
| 2018/0230934 | A1* | 8/2018 | Hopf | F01P 3/02 | |

FOREIGN PATENT DOCUMENTS

| | | | | | |
|---|---|---|---|---|---|
| CN | 107152349 | A | | 9/2017 | |
| DE | 3120642 | A1 | | 12/1982 | |
| DE | 2660452 | C2 | | 3/1984 | |
| DE | 3804796 | A1 | | 7/1989 | |
| DE | 68905367 | | | 8/1993 | |
| DE | 10039790 | A1 | | 2/2002 | |
| DE | 102005025731 | A1 | | 12/2006 | |
| DE | 102015109531 | A1 | | 6/2016 | |
| GB | 1322495 | A | | 7/1973 | |
| JP | S53113912 | A | | 10/1978 | |
| JP | 02271058 | A | * | 11/1990 | F02F 1/32 |
| JP | 2013221459 | A | * | 10/2013 | |

OTHER PUBLICATIONS

German Search Report issued in German Patent Application No. 102018121723.4 dated Jun. 4, 2019, 10 pages. No English translation available.

PCT Search Report and Written Opinion issued in PCT/EP2019/073192 dated Oct. 22, 2019, 13 pages. No English translation available.

Decision to Grant issued in Russian Patent Application No. 2020140898/12 dated Sep. 29, 2022 with English translation.

Notification of the First Office Action issued in Chinese Patent Application No. 201980057876.0 dated Sep. 5, 2022 with English translation.

Notice of Second Office Action issued in Chinese Patent Application No. 201980057876.0 dated Mar. 14, 2023, with English translation through google translate.

Decision of Rejection issued in Chinese Patent Application No. 201980057876.0 dated Jul. 26, 2023 with English translation.

Brazilian Office Action issued in Brazilian Patent Application No. BR112020026772-4 dated Jun. 8, 2023 with English translation.

* cited by examiner

CYLINDER HEAD FOR AN INTERNAL COMBUSTION ENGINE AND METHOD FOR THE PRODUCTION THEREOF

FIELD

The disclosure relates to a cylinder head for covering a combustion chamber of an internal combustion engine, and to a method for the production of a cylinder head.

BACKGROUND

DE 100 39 790 A1 discloses a cylinder head of an internal combustion engine with outlet ducts which are arranged therein and have a duct inner frame which is formed from at least one sheet metal layer.

DE 10 2005 025 731 A1 discloses an exhaust gas routing system of an internal combustion engine, the exhaust gas routing system comprising at least one exhaust gas duct which runs in the cylinder head of the internal combustion engine, and an exhaust gas system which adjoins the cylinder head on the outlet side. A member which is insulated by an air gap is arranged in the exhaust gas duct at least over the region of the exhaust gas outlet. The member is a thin-walled sleeve-shaped insert which is fastened in the exhaust gas duct and has means, by way of which the insert is spaced apart radially from the duct wall. As an alternative, the member can be formed by way of an exhaust gas pipe of the exhaust gas system, which exhaust gas pipe protrudes freely into the exhaust gas duct, the exhaust gas duct being widened in the region, into which the exhaust gas pipe protrudes, with the configuration of a stepped shoulder, and the member covering the shoulder edge in a radially outwardly circumferential manner.

Although the known apparatuses can develop a thermally insulating effect with regard to the exhaust gas duct, they are complicated to produce and/or to assemble.

SUMMARY

The disclosure provides an alternative and/or improved cylinder head for an internal combustion engine.

The disclosure provides a cylinder head (for example, a single-cylinder cylinder head or a multiple-cylinder cylinder head) for covering a combustion chamber of an internal combustion engine. The cylinder head has a fluid conducting duct for feeding in a fluid (for example, inlet air, charge air and/or air/fuel mixture) to the combustion chamber or for discharging a fluid (for example, exhaust gas or compressed air) from the combustion chamber. The cylinder head has a cooling duct for a cooling fluid (for example, water, water/coolant mixture or oil) for cooling the cylinder head. The cylinder head has at least one material cutout for thermal insulation which is formed in a main body of the cylinder head (for example, by way of casting of the cylinder head). The at least one material cutout is arranged between the fluid conducting duct and the cooling duct. The at least one material cutout is arranged in a manner which is separated from the fluid conducting duct by way of the main body (for example, by way of a supporting region of the main body for the support of the fluid conducting duct in the main body).

The at least one material cutout can be produced simply, for example directly during the primary forming (for example, casting) of the main body of the cylinder head and/or subsequently thereto. The material cutout can afford different advantages depending on the configuration of the fluid conducting duct. The advantages are based in each case on (partial) thermal decoupling of the fluid conducting duct and the cooling duct by way of the at least one thermally insulating material cutout. For example, in the case, in which exhaust gas is conducted through the fluid conducting duct, a considerably lower thermal input can take place from the hot exhaust gas into the cooling fluid. This leads to a reduction of the cooling requirement, which makes an improved design of the cooling system possible. As a result, for example, a fuel consumption of the internal combustion engine can be decreased, for example also as a result of energy savings in the case of the driving of a coolant pump. In addition, the thermal decoupling leads to the hot exhaust gas cooling to a less pronounced extent in the fluid conducting duct. As a result, more exhaust gas enthalpy is available for an exhaust gas turbocharger and/or an exhaust gas aftertreatment apparatus which are/is possibly arranged downstream. This makes an improved design and improved degrees of efficiency of said components and a reduction of the fuel consumption possible.

The term "material cutout" used herein can expediently be understood in such a way that it relates to a material cutout which is provided deliberately by way of a corresponding production step, and not, for instance, to cavities or the like which are produced unintentionally during casting or printing.

The fluid conducting duct can expediently be formed without an insert, for example a tubular insert.

For example, the at least one material cutout through the main body can be spaced apart radially from a duct wall or an outer contour of the fluid conducting duct.

In one embodiment, the at least one material cutout is produced by way of primary forming, reshaping and/or cutting.

In a further embodiment, the main body is cast or printed (for example, by means of 3D printer).

In a further embodiment, the at least one material cutout is formed during the primary forming, for example, during the casting and/or printing (for example, by means of 3D printer), of the main body or subsequent thereto, for example, by way of a cutting production method (for example, drilling, milling or the like).

In one exemplary embodiment, the fluid conducting duct is configured as an exhaust gas duct, an inlet duct (for example, an air inlet duct or an air/fuel mixture inlet duct) or a compressed air removal duct. For example, in the case of the inlet duct, the inlet air, which may be at a temperature of between 30° C. and 50° C., is heated to a less pronounced extent by way of the cooling fluid which is typically at a temperature of above 90° C. This can make, for example, an improved design of intercoolers, etc. possible.

It is possible that a plurality of fluid conducting ducts (for example, two exhaust gas ducts and/or two inlet ducts) are included in the cylinder head, and the at least one material cutout for thermal insulation is arranged between the plurality of fluid conducting ducts on one side and the cooling duct on the other side.

In a further exemplary embodiment, the cylinder head has a valve, for example, a poppet valve, which is arranged for sealing the fluid conducting duct on the combustion chamber side.

In one exemplary embodiment, the at least one material cutout is configured such that it reduces or substantially reduces a transmission of heat between the cooling duct and the fluid conducting duct.

In a further exemplary embodiment, the at least one material cutout is configured such that it insulates the fluid conducting duct and the cooling duct thermally from one another at least partially.

In one embodiment, the at least one material cutout is filled with and/or flowed through by air, for example, ambient air.

In a further embodiment, the at least one material cutout forms an air gap (which is, for example, thermally insulating, for example with a gap size of greater than or equal to 5 mm and/or smaller than or equal to 15 mm) between the fluid conducting duct and the cooling duct.

In a further embodiment, the at least one material cutout is filled with a thermal insulation material (for example, partially or completely).

In one design variant, an outer contour of the at least one material cutout follows an outer contour of the fluid conducting duct and/or of the cooling duct at least in sections, for example, at a substantially constant spacing.

In a further design variant, the at least one material cutout surrounds the fluid conducting duct in sections or completely.

In a further design variant, the at least one material cutout has a ring segment-shaped cross section and/or is of sleeve segment-shaped configuration.

In one exemplary embodiment, the at least one material cutout follows the fluid conducting duct along at least 50%, 60%, 70%, 80% or 90% of a length of the fluid conducting duct, for example, at a substantially constant spacing.

In a further exemplary embodiment, the at least one material cutout ends adjacently with respect to a cylinder head bottom region of the main body.

In a further exemplary embodiment, the at least one material cutout opens into an outer face (for example, circumferential face) of the cylinder head in order, for example, to enable a circulation of air through the at least one material cutout.

For example, the at least one material cutout can extend through the main body, for example in a curved shape, from an opening in a circumferential face of the main body as far as adjacently with respect to the cylinder head bottom region of the main body.

In a further exemplary embodiment, the at least one material cutout encloses the fluid conducting duct substantially completely with the exception of a cylinder head bottom region of the main body and/or a supporting region of the main body, which supporting region is required for the support of the fluid conducting duct.

In one embodiment, the at least one material cutout encloses the fluid conducting duct at least partially.

In a further embodiment, the at least one material cutout has a plurality of cutout regions. The plurality of cutout regions may be connected fluidically to one another, by way of, for example, ducts in the main body. It is possible that the plurality of cutout regions are arranged symmetrically around the fluid conducting duct. It is also possible that the plurality of cutout regions in each case have a ring segment-shaped cross section and/or together surround the fluid conducting duct in an annular manner. Furthermore, it is possible that the plurality of cutout regions are in each case of sleeve segment-shaped configuration and/or together surround the fluid conducting duct in a sleeve-shaped manner.

In one design variant, a material thickness of the main body between the fluid conducting duct and the at least one material cutout is greater than or equal to 5 mm and/or less than or equal to 10 mm.

In a further design variant, a material cutout thickness of the at least one material cutout in, for example, a radial direction of the fluid conducting duct is greater than or equal to 5 mm and/or smaller than or equal to 15 mm.

In a further exemplary embodiment, the fluid conducting duct has an opening on an outer side of the cylinder head, and the at least one material cutout has an opening on the outer side of the cylinder head. The opening of the at least one material cutout may surround the opening of the fluid conducting duct at least partially, for example, in a ring segment-shaped manner.

In one development, an annular web section may be formed between the opening of the fluid conducting duct and the opening of the at least one material cutout. The web section may have at least one fastening device, for example, a threaded hole, for the attachment of a fluid line in a fluidic connection to the fluid conducting duct.

In one embodiment, the main body has a supporting region which is arranged (for example, with regard to a radial direction of the fluid conducting duct) between the fluid conducting duct and the at least one material cutout for the support of the fluid conducting duct in the main body. As an alternative or in addition, the at least one material cutout is configured such that it is separated fluidically from the fluid conducting duct, for example by means of the supporting region.

In a further embodiment, the cooling duct is arranged for cooling a cylinder head bottom region of the main body and/or adjacently with respect to a cylinder head bottom region of the main body.

The disclosure also relates to a motor vehicle, for example, a utility vehicle (for example, a truck or an omnibus), with a cylinder head as disclosed herein.

It is also possible for the apparatus as disclosed herein to be used for passenger motor cars, off-road vehicles, large engines, stationary engines, marine engines, etc.

The present disclosure also relates to a method for the production of a cylinder head which may be configured as disclosed herein. The method comprises primary forming (for example, casting and/or printing) of the main body of the cylinder head, the at least one material cutout being produced in the main body directly during the primary forming of the main body and/or following the primary forming of the main body.

BRIEF DESCRIPTION OF DRAWINGS

The above-described embodiments and features of the disclosure can be combined with one another as desired. Further details and advantages of the disclosure will be described in the following text with reference to the appended drawings, in which.

The embodiments which are shown in the figures correspond at least partially, with the result that similar or identical parts are provided with the same designations and, for the description thereof, reference is also made to the description of the other embodiments and/or figures, in order to avoid repetitions.

DETAILED DESCRIPTION

Figure 1:
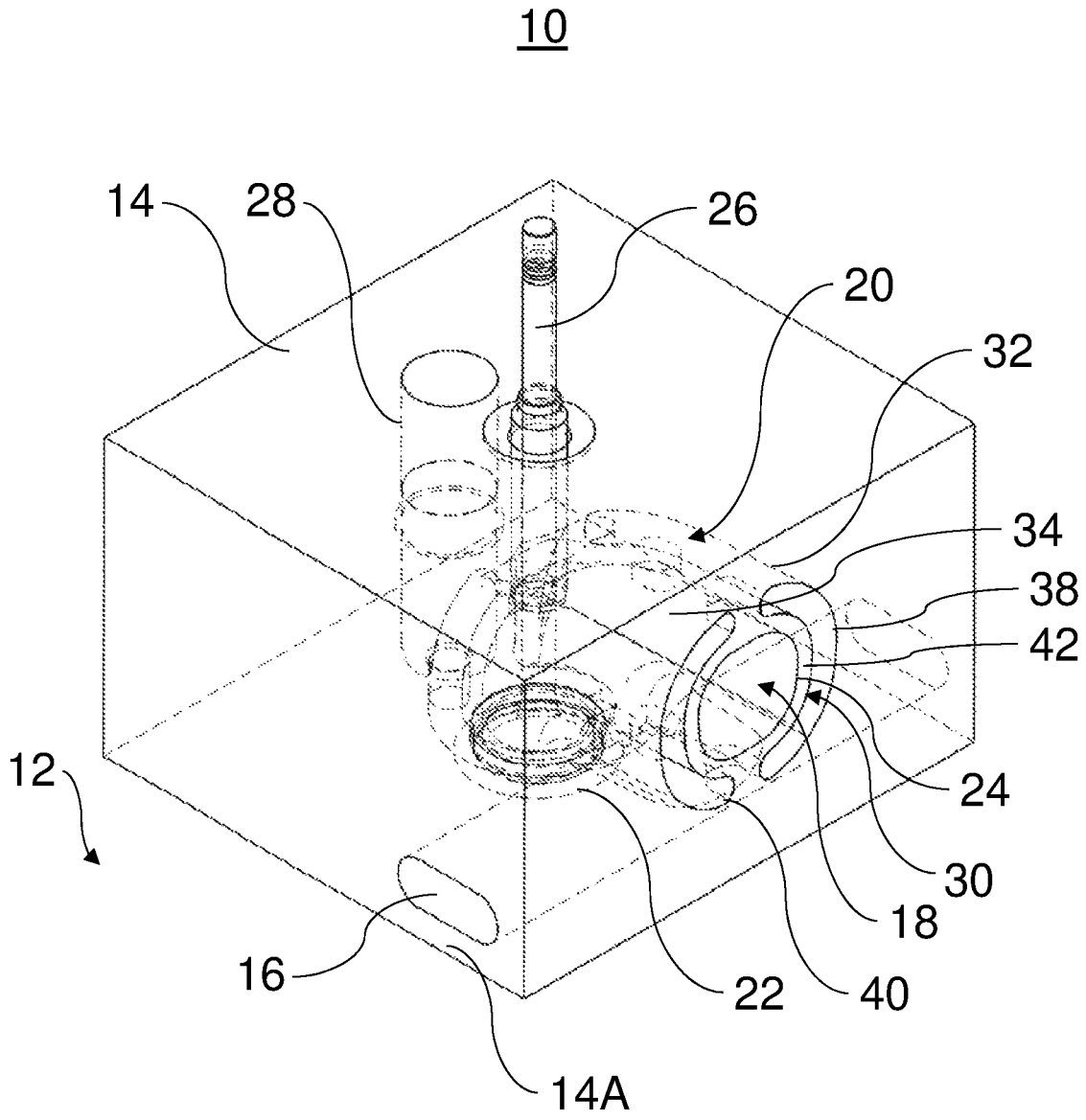
FIG. 1 shows a perspective view of a region of a diagrammatically illustrated cylinder head in accordance with one exemplary embodiment of the present disclosure.
Figure 2:
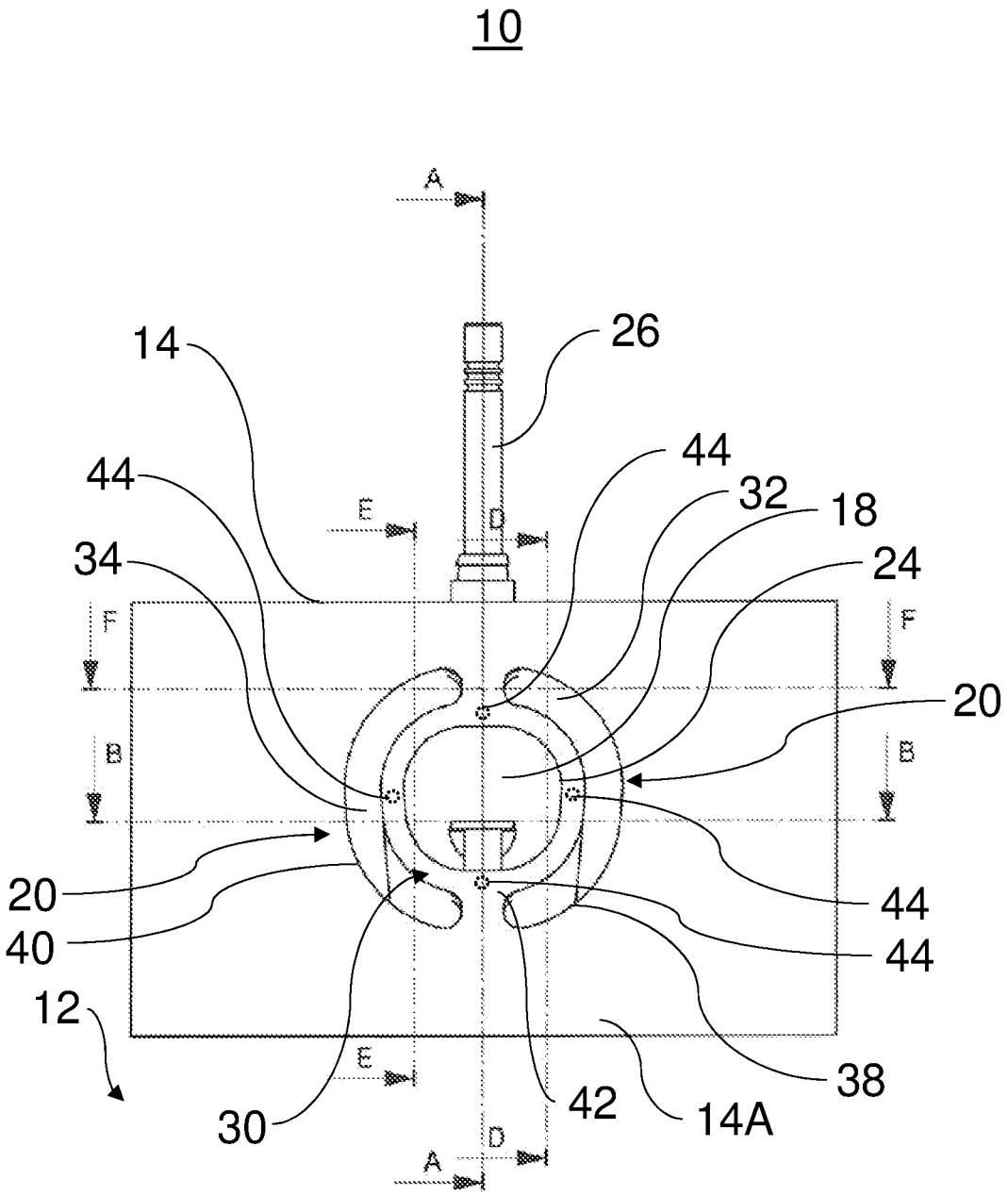
FIG. 2 shows a side view of the region of the exemplary cylinder head.
Figure 3:
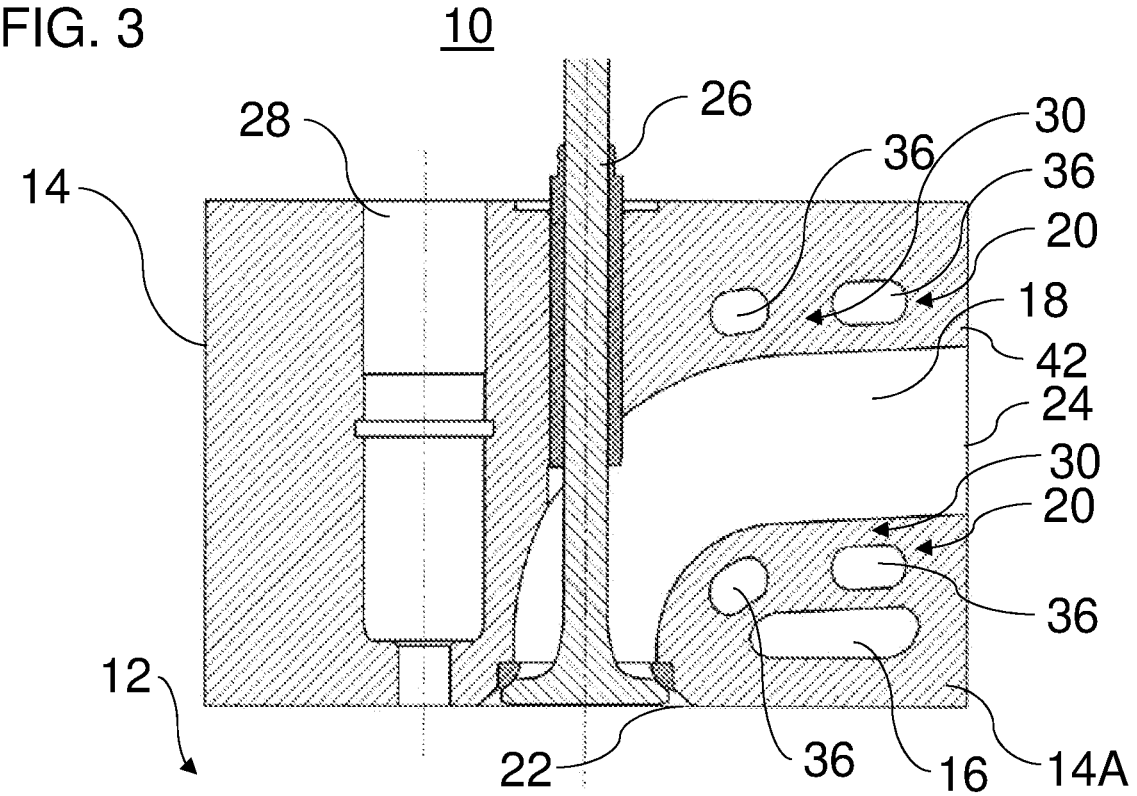
FIG. 3 shows a sectional view of the region of the exemplary cylinder head along the line A-A in FIG. 2.
Figure 4:
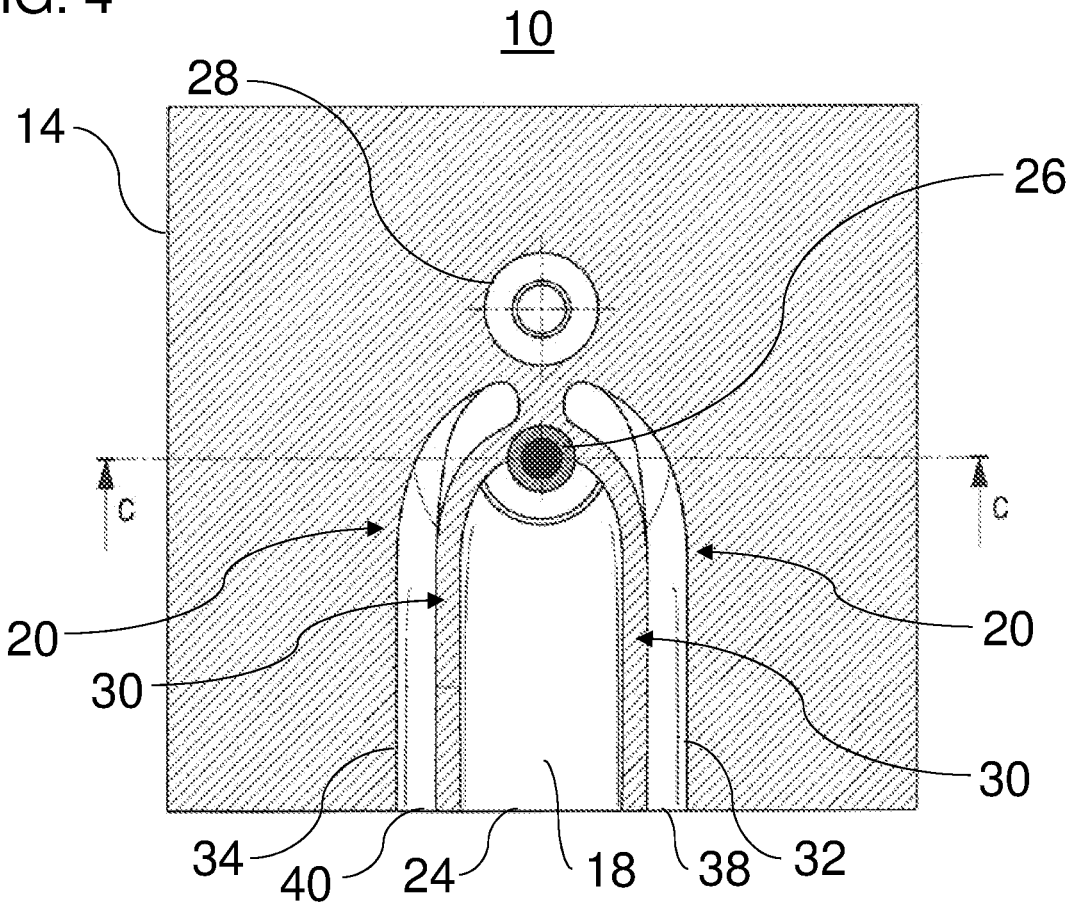
FIG. 4 shows a sectional view of the region of the exemplary cylinder head along the line B-B in FIG. 2.
Figure 5:
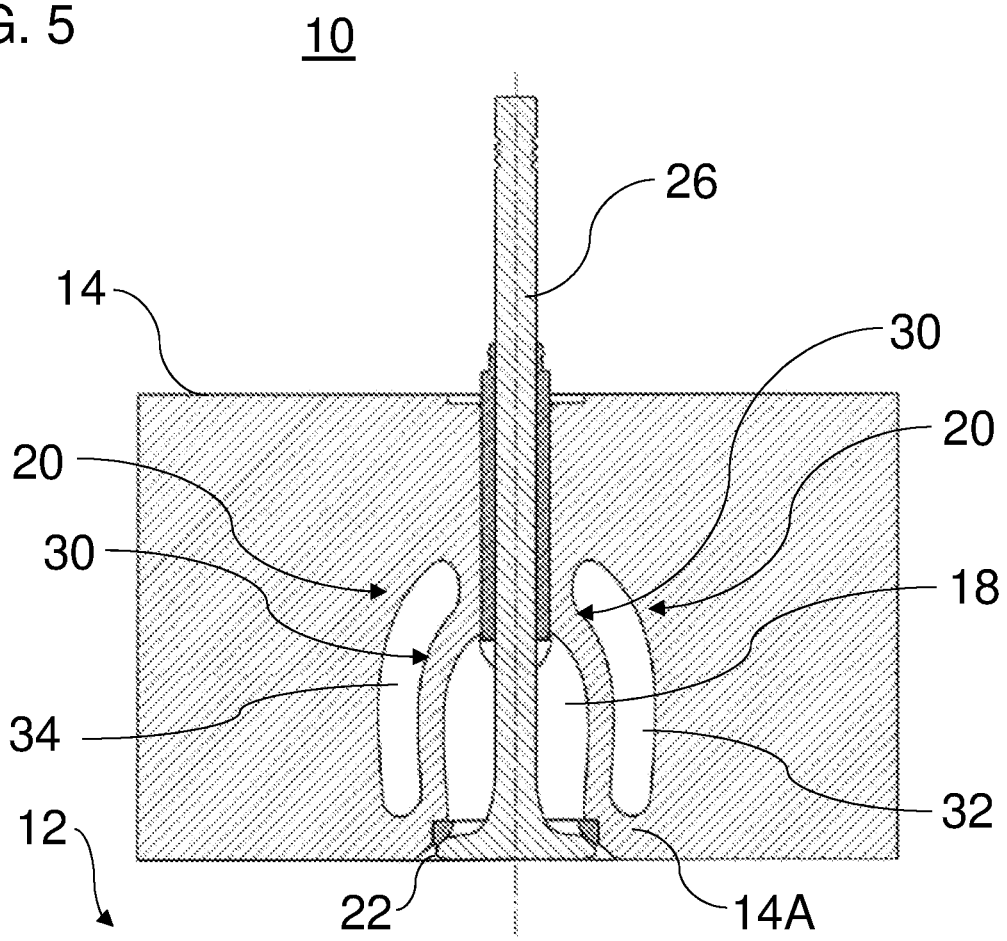
FIG. 5 shows a sectional view of the region of the exemplary cylinder head along the line C-C in FIG. 4.
Figure 6:
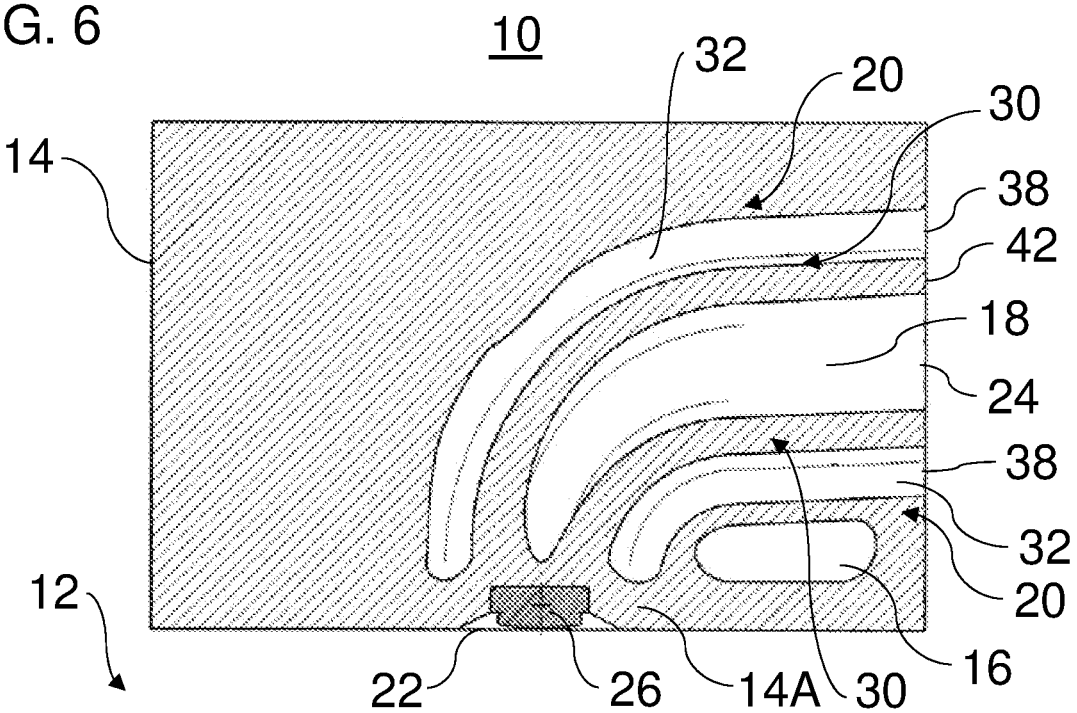
FIG. 6 shows a sectional view of the region of the exemplary cylinder head along the line D-D in FIG. 2.
Figure 7:
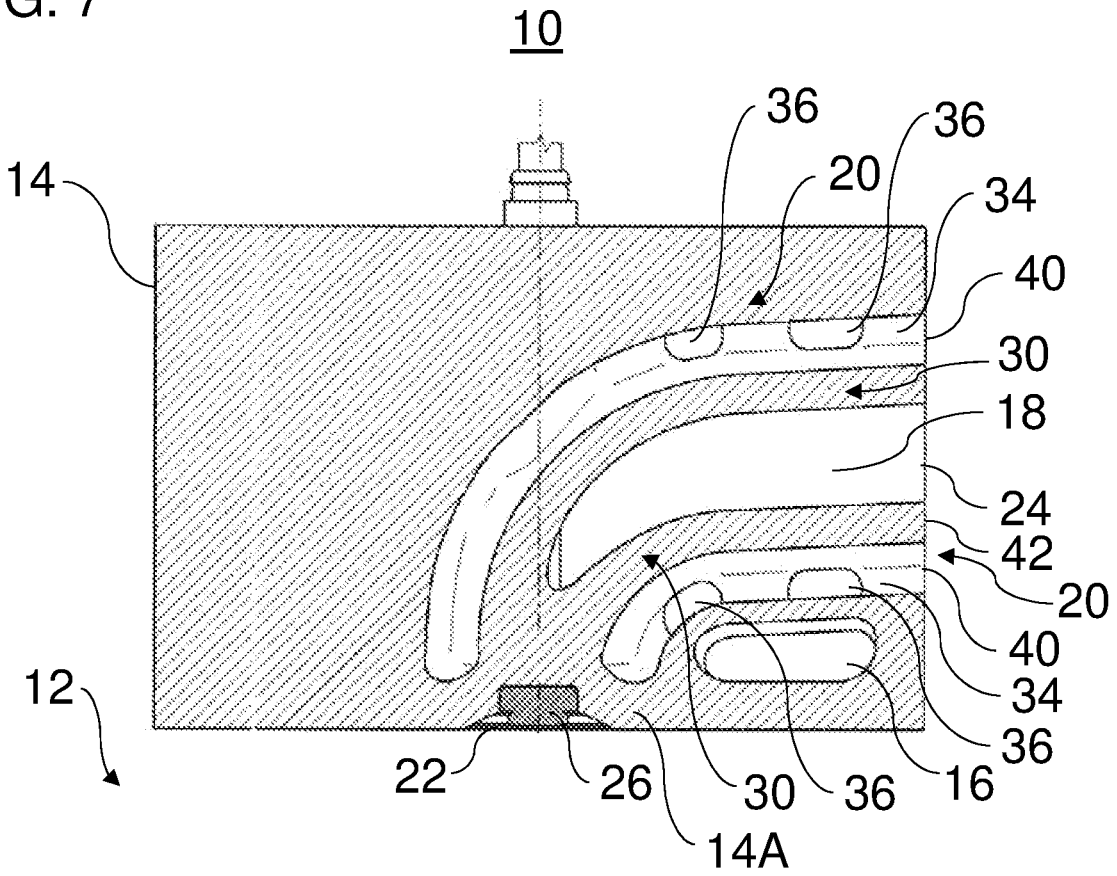
FIG. 7 shows a sectional view of the region of the exemplary cylinder head along the line E-E in FIG. 2.
Figure 8:
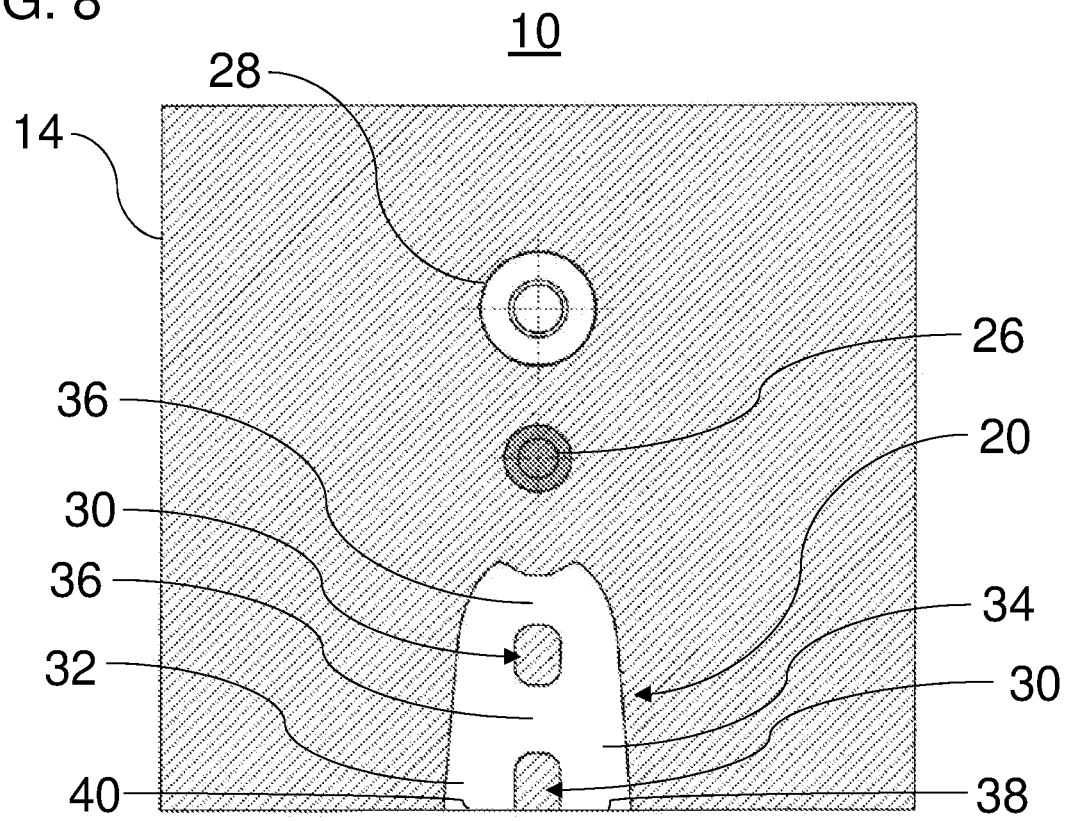
FIG. 8 shows a sectional view of the region of the exemplary cylinder head along the line F-F in FIG. 2.

FIGS. 1 to 8 show a region of a diagrammatically illustrated cylinder head 10. The cylinder head 10 can be configured as a single-cylinder cylinder head or a multiple-cylinder cylinder head. The cylinder head 10 can cover one or more combustion chambers 12 of an internal combustion engine, in particular of a reciprocating piston internal combustion engine. The internal combustion engine can be contained, for example, in a motor vehicle, for example, a utility vehicle (for example, a truck or an omnibus).

The cylinder head 10 is cast. In other words, the cylinder head 10 has an expediently metallic main body 14. The main body 14 can be produced by way of any known method. For example, the main body 14 can be cast, for example as a GJV cast body (compacted graphite iron). It is also possible that the main body 14 is printed, for example, by means of a 3D printer.

Various structures are formed in the main body 14, for example, by way of the casting process or the printing process. These include a cooling duct 16, a fluid conducting duct 18, and one or more clearances or material cutouts 20. In addition to the illustrated region of the diagrammatically shown cylinder head 10, the cylinder head 10 has further regions with, for example, one or more further fluid conducting ducts, one or more further cooling ducts and/or valves, etc. Furthermore, for example, a seat 28, for example for a fuel injector, can be configured in the main body 14.

The cooling duct 16 conducts a cooling fluid, for example water, a water/coolant mixture or oil, for cooling the cylinder head 10. The cooling duct 16 can be configured, for example, as a part of a water jacket of the cylinder head 10. The illustrated cooling duct 16 is arranged adjacently with respect to a cylinder head bottom region 14A of the main body 14 of the cylinder head 10 for cooling the combustion chamber side of the cylinder head 10.

The fluid conducting duct 18 serves to feed in a fluid to the combustion chamber 12 or to discharge a fluid from the combustion chamber 12. The fluid conducting duct 18 may be particularly configured as an exhaust gas duct for the discharge of exhaust gas from the combustion chamber 12. It has been recognized, however, that advantageous effects likewise result from the material cutout 20 if the fluid conducting duct 18 is configured, for example, as an inlet duct for feeding in inlet air to the combustion chamber 12 or as a compressed air removal duct for the discharge of compressed air from the combustion chamber 12.

The fluid conducting duct 18 has a combustion chamber-side opening 22. The fluid conducting duct 18 has an opening 24 in an outer side, for example, a circumferential face, of the cylinder head 10. The fluid conducting duct 18 extends (for example, in a curved manner) between the opening 22 and the opening 24. The fluid conducting duct 18 can be sealed on the combustion chamber side by means of a valve 26, for example, a poppet valve, of the cylinder head 10.

The material cutout 20 is arranged between the fluid conducting duct 18 and the cooling duct 16. The material cutout 20 decouples the fluid conducting duct 18 thermally from the cooling duct 16. The material cutout 20 reduces a transmission of heat between the fluid conducting duct 18 and the cooling duct 16 substantially, that is to say significantly.

In an exemplary embodiment with the fluid conducting duct 18 which is configured as an exhaust gas duct, this makes it possible that the transmission of heat between the exhaust gas and the cooling fluid in the cooling duct 16 can be reduced significantly. A lower input of heat into the cooling fluid leads to a reduction in the cooling requirement, which makes an improved design of the cooling system possible. As a result, for example, a fuel consumption of the internal combustion engine can be reduced, for example also by way of energy savings in the case of the driving of a coolant pump. In addition, the thermal decoupling leads to the exhaust gas which flows through the fluid conducting duct 18 and, for example, is at a temperature of approximately 600° C. cooling to a less pronounced extent. As a result, more exhaust gas enthalpy is available for an exhaust gas turbocharger which is possibly arranged downstream. As an alternative or in addition, more exhaust gas enthalpy can be available for an exhaust gas aftertreatment apparatus which is possibly arranged downstream. For example, the exhaust gas aftertreatment apparatus can require a certain high temperature range for effective operation (for example, in the case of an SCR catalytic converter). This makes an improved design and improved degrees of efficiency of said components and a reduction of the fuel consumption possible.

The material cutout 20 can also, however, be used, for example, for thermal decoupling of a fluid conducting duct 18 which is configured as an inlet duct. In this case, the material cutout 20 reduces a transmission of heat from the cooling fluid in the cooling duct 16 which, for example, is at a temperature above 90° C. to the inlet air which flows through the fluid conducting duct 18 and may be at a low temperature, for example below 40° C. or 50° C.

The material cutout 20 may be formed directly as a material cutout during the primary forming (for example, printing or casting) of the main body 14, for example as a cast material cutout. It is also possible, however, that the material cutout 20 is configured in the main body 14 only after the primary forming of the main body 14, for example by way of a machining production method. For example, a plurality of bores which surround the fluid conducting duct 18 can be made in the main body 14.

A supporting region 30 is arranged between the material cutout 20 and the fluid conducting duct 18. The supporting region 30 is part of the main body 14. The supporting region 30 is cast. The supporting region 30 supports the fluid conducting duct 18 in the main body 14. The supporting region 30 separates the material cutout 20 and the fluid conducting duct 18 from one another fluidically. A material thickness of the supporting region 30 between the fluid conducting duct 18 and the material cutout 20 can lie, for example, in a range between 5 mm and 10 mm. The supporting region 30 is to be configured in such a way that it is to be as rigid as necessary for the support of the fluid conducting duct 18 and as flexible as possible for the compensation of, for example, temperature-induced material expansions.

The material cutout 20 is filled with air, for example, ambient air. As a result, the material cutout 20 forms a heat-insulating air gap between the fluid conducting duct 18 and the cooling duct 16. The gap size of the air gap can lie, for example, in a range between 5 mm and 15 mm. It can also be possible that the material cutout 20 is filled at least partially with a thermally insulating material.

The material cutout 20 can be open toward an outer side of the main body 14. This makes it possible that the air in the material cutout 20 can be swapped with the ambient air and an air circulation results. It is also possible, however, that the material cutout 20 is arranged in the main body 14 has a cavity without an opening to the outside.

The outer contour or wall contour of the material cutout 20 is adapted to an outer contour or wall contour of the fluid conducting duct 18 and follows the latter, for example, at least partially at a constant spacing. For example, the outer contour of the material cutout 20 can be configured at least partially as a cylinder shell segment, on the inner side of which the fluid conducting duct 18 runs. It is also possible that the outer contour of the material cutout 20 is adapted additionally or as an alternative to the cooling duct 16 and follows the latter, for example, at least partially at a constant spacing.

Starting from an outer side of the cylinder head 10, the material cutout 20 follows the fluid conducting duct 18 along a substantial part of a length of the fluid conducting duct 18. As is shown, the material cutout 20 can follow the fluid conducting duct 18, for example, over between 80% and 90% of the length of the fluid conducting duct 18. The material cutout 20 encloses the fluid conducting duct 18 substantially completely, except for the cylinder head bottom region 14A of the main body 14 and the supporting region 30 of the main body 14.

In the exemplary embodiment which is shown, the material cutout 20 has two cutout regions 32, 34. The cutout regions 32, 34 are connected fluidically to one another via a plurality of ducts 36, as is shown. It is also possible for more or fewer cutout regions to be provided which can be connected fluidically to one another or not.

The cutout regions 32, 34 are arranged in an annular manner around the fluid conducting duct 18. The cutout regions 32, 34 can surround the fluid conducting duct 18, for example, in a symmetrical manner. The cutout regions 32, 34 in each case have a ring segment-shaped cross section. The ring segment-shaped cross sections can, for example, in each case comprise an angular range of approximately 180°. The cutout regions 32, 34 follow a course of the fluid conducting duct 18 in the form of sleeve segments.

The cutout regions 32, 34 end adjacently with respect to the cylinder head bottom region 14A of the main body 14. On the other side, the cutout regions 32, 34 open in an outer side of the main body 14. The cutout regions 32, 34 in each case have an opening 38, 40. The openings 38, 40 are arranged around the opening 24. The openings 38, 40 have a ring segment shape. Air can flow into the cutout regions 32, 34 and out of them through the openings 38, 40, which results in an air circulation in the cutout regions 32, 34 and therefore in the material cutout 20.

A web section 42 of the supporting region 30 is arranged between the opening 24 on one side and the openings 38, 40 on the other side. The web section 42 can be ring-shaped. The web section 42 surrounds the opening 24. The web section 42 can have one or more fastening devices 44 (shown diagrammatically merely in FIG. 2) which are configured for the attachment of a fluid line to the fluid conducting duct 18. For example, the fastening devices 44 can be configured as threaded holes for screwing in fastening screws.

The disclosure is not restricted to the above-described exemplary embodiments. Rather, a multiplicity of variants and modifications are possible which likewise use the concept of the disclosure and therefore fall within the scope of protection. In particular, the disclosure also claims protection for the subject matter and the features of the subclaims independently of the claims which are referred to. In particular, the features of independent claim 1 are disclosed independently of one another. In addition, the features of the subclaims are also disclosed independently of all the features of independent claim 1 and, for example, independently of the features with regard to the presence and/or the configuration of the fluid conducting duct, the cooling duct and/or the at least one material cutout of independent claim 1. All range specifications herein are to be understood to be disclosed in such a manner that, as it were, all the values which fall within the respective range are disclosed individually, for example, also as respective narrower external limits of the respective range.

LIST OF DESIGNATIONS

10 Cylinder head
12 Combustion chamber
14 Main body
14A Cylinder head bottom region
16 Cooling duct
18 Fluid conducting duct
20 Material cutout
22 Opening
24 Opening
26 Valve
28 Seat
30 Supporting region
32 Cutout region
34 Cutout region
36 Duct
38 Opening
40 Opening
42 Web section
44 Fastening device

What is claimed is:

1. A cylinder head for covering a combustion chamber of an internal combustion engine, comprising:

a fluid conducting duct for feeding in a fluid to or discharging a fluid from the combustion chamber;

a cooling duct for a cooling fluid for cooling the cylinder head; and at least one material cutout for thermal insulation, wherein the at least one material cutout is formed in a main body of the cylinder head and is arranged between the fluid conducting duct and the cooling duct, such that the at least one material cutout thermally insulates the fluid conducting duct from the cooling duct;

wherein the at least one material cutout is arranged such that the at least one material cutout is separated from the fluid conducting duct by way of the main body, and wherein the at least one material cutout has a plurality of cutout regions which:

a) in each case have a ring segment-shaped cross section and together surround the fluid conducting duct in an annular manner; or b) are in each case of a sleeve segment-shaped configuration and together surround the fluid conducting duct in a sleeve-shaped manner.

2. The cylinder head as claimed in claim 1, wherein:
the at least one material cutout is produced by way of primary forming, reshaping and/or cutting; and/or
the main body is cast or printed; and/or
the at least one material cutout is formed during the primary forming of the main body or subsequently thereto.

3. The cylinder head as claimed in claim 2, wherein the at least one material cutout is formed during the casting or printing of the main body or subsequently thereto by way of a cutting production method.

4. The cylinder head as claimed in claim 1, wherein:
the fluid conducting duct is configured as an exhaust gas duct, an inlet duct or a compressed air removal duct; and/or
the cylinder head has a valve which is arranged for sealing the fluid conducting duct on the combustion chamber side; and/or
the cooling duct is arranged for cooling a cylinder head bottom region of the main body; and/or
the cooling duct is arranged adjacently with respect to a cylinder head bottom region of the main body.

5. The cylinder head as claimed in claim 4, wherein the valve is a poppet valve.

6. The cylinder head as claimed in claim 1, wherein:
the at least one material cutout is configured such that it reduces a transmission of heat between the cooling duct and the fluid conducting duct; and/or
the at least one material cutout is configured such that it insulates the fluid conducting duct and the cooling duct thermally from one another at least partially.

7. The cylinder head as claimed in claim 1, wherein:
the at least one material cutout is filled with and/or is flowed through by ambient air; and/or
the at least one material cutout forms an air gap between the fluid conducting duct and the cooling duct; and/or
the at least one material cutout is filled with a thermal insulation material.

8. The cylinder head as claimed in claim 1, wherein:
an outer contour of the at least one material cutout follows an outer contour of the fluid conducting duct and/or of the cooling duct at least in sections at a substantially constant spacing; and/or
the at least one material cutout surrounds the fluid conducting duct in sections or completely; and/or
the at least one material cutout has a ring segment-shaped cross section or is of a sleeve segment-shaped configuration.

9. The cylinder head as claimed in claim 1, wherein:
the at least one material cutout follows the fluid conducting duct along at least 50%, 60%, 70%, 80% or 90% of a length of the fluid conducting duct at a substantially constant spacing; and/or
the at least one material cutout ends adjacently with respect to a cylinder head bottom region of the main body; and/or
the at least one material cutout opens into an outer face of the cylinder head in order to enable circulation of air through the at least one material cutout.

10. The cylinder head as claimed in claim 1, wherein:
the at least one material cutout encloses the fluid conducting duct substantially completely with the exception of a cylinder head bottom region of the main body and a supporting region of the main body, wherein the supporting region supports the fluid conducting duct; and/or
the at least one material cutout encloses the fluid conducting duct at least partially.

11. The cylinder head as claimed in claim 1, wherein the at least one material cutout has a plurality of cutout regions which:
are connected fluidically to one another by way of ducts in the main body, and/or
are arranged symmetrically around the fluid conducting duct.

12. The cylinder head as claimed in claim 1, wherein:
a material thickness of the main body between the fluid conducting duct and the at least one material cutout is greater than or equal to 5 mm and/or less than or equal to 10 mm; and/or
a material cutout thickness of the at least one material cutout in a radial direction of the fluid conducting duct is greater than or equal to 5 mm and/or less than or equal to 15 mm.

13. The cylinder head as claimed in claim 1, wherein:
the fluid conducting duct has an opening on an outer side of the cylinder head; and
the at least one material cutout has an opening on the outer side of the cylinder head, wherein the opening surrounds the opening of the fluid conducting duct at least partially in a ring segment-shaped manner.

14. The cylinder head as claimed in claim 13, further comprising an annular web section formed between the opening of the fluid conducting duct and the opening of the at least one material cutout,
wherein the annular web section has at least one fastening device for attachment of a fluid line in a fluidic connection to the fluid conducting duct.

15. The cylinder head as claimed in claim 14, wherein the at least one fastening device is a threaded hole.

16. The cylinder head as claimed in claim 1, wherein:
the main body has a supporting region which is arranged between the fluid conducting duct and the at least one material cutout for the support of the fluid conducting duct in the main body; and/or
the at least one material cutout is configured such that it is separated fluidically from the fluid conducting duct.

17. A motor vehicle with a cylinder head as claimed in claim 1.

18. The motor vehicle as claimed in claim 17, wherein the motor vehicle is a utility vehicle.

19. A method for producing a cylinder head as claimed in claim 1, comprising:
primary forming of the main body of the cylinder head, the at least one material cutout being produced in the main body directly during the primary forming of the main body and/or following the primary forming of the main body.

20. The method as claimed in claim 19, wherein the primary forming is casting or printing.

* * * * *